US007871295B2

(12) United States Patent
Zhang et al.

(10) Patent No.: US 7,871,295 B2
(45) Date of Patent: Jan. 18, 2011

(54) COAXIAL CONNECTOR HAVING IMPROVED CENTRAL PIN

(75) Inventors: Xiao-Guo Zhang, Kunshan (CN); Qing-Man Zhu, Kunshan (CN)

(73) Assignee: Hon Hai Precision Ind. Co., Ltd., Taipei Hsien (TW)

( * ) Notice: Subject to any disclaimer, the term of this patent is extended or adjusted under 35 U.S.C. 154(b) by 0 days.

(21) Appl. No.: 12/508,782

(22) Filed: Jul. 24, 2009

(65) Prior Publication Data

US 2010/0022123 A1 Jan. 28, 2010

(30) Foreign Application Priority Data

Jul. 24, 2008 (CN) ..... 2008 2 0039110

(51) Int. Cl.
*H01R 9/05* (2006.01)

(52) U.S. Cl. ..... 439/578

(58) Field of Classification Search ..... 439/578, 439/675, 581, 582, 188
See application file for complete search history.

(56) References Cited

U.S. PATENT DOCUMENTS 3,673,546 A * 6/1972 Green et al. ..... 439/172
4,336,974 A * 6/1982 Wilson ..... 439/13
4,556,271 A * 12/1985 Hubbard ..... 439/277
4,846,731 A * 7/1989 Alwine ..... 439/651
5,160,280 A * 11/1992 Chuang ..... 439/675
5,215,470 A * 6/1993 Henry et al. ..... 439/63
5,217,391 A * 6/1993 Fisher, Jr. ..... 439/578
5,219,299 A * 6/1993 Wang ..... 439/188
5,387,116 A * 2/1995 Wang ..... 439/188
5,730,622 A * 3/1998 Olson ..... 439/578
5,857,867 A * 1/1999 Henry ..... 439/290
6,174,206 B1 * 1/2001 Yentile et al. ..... 439/638
6,250,960 B1 * 6/2001 Youtsey ..... 439/578
6,407,562 B1 * 6/2002 Whiteman ..... 324/754
6,672,913 B1 * 1/2004 Wang ..... 439/874
7,435,096 B2 * 10/2008 Wang et al. ..... 439/63
2002/0193007 A1 * 12/2002 Botka et al. ..... 439/675
2005/0277331 A1 * 12/2005 Hall ..... 439/578

FOREIGN PATENT DOCUMENTS

CN 101132086 2/2008

* cited by examiner

*Primary Examiner*—T C Patel
*Assistant Examiner*—Harshad C Patel
(74) *Attorney, Agent, or Firm*—Ming Chieh Chang; Wei Te Chung; Andrew C. Cheng

(57) ABSTRACT

A coaxial connector (100) includes a bracket (10) defining a cavity (15), a central pin (30) received in the cavity and an insulative member (20). The central pin includes a contact portion (31), a mounting portion (32), and a fixing portion (33) disposed between the contact portion and the mounting portion. The fixing portion has at least an engaging face (331) extending along a direction angled to a rotating direction of the central pin. The insulative member is mounted around the fixing portion of the central pin and disposed between the bracket and the central pin. The insulative member includes a working face (211) engaging with the engaging face of the central pin.

8 Claims, 5 Drawing Sheets

COAXIAL CONNECTOR HAVING IMPROVED CENTRAL PIN

BACKGROUND OF THE INVENTION

1. Field of the Invention

The present invention relates to a coaxial connector, and more particularly to a coaxial connector including a central pin having a flattened engaging face cooperating with an insulative member to withstand an excessive torsional force.

2. Description of Related Art

CN Patent publication No. 101132086 submitted by Suzhou Wutong and published on Feb. 27, 2008 discloses connecting structure comprising a bracket, an insulative member retained in the bracket, a central pin embedded in the insulative member. The bracket has a plurality of key-shaped recesses formed around an inner surface thereof. The central pin is formed with an interferential face. The insulative member would be securely fastened in the bracket, due to the engagement between the key-shaped recesses and the outer face of the insulative member. Additionally, the central pin would be secured in the insulative member, due to the engagement between the interferential face of the central pin and the inner face of the insulative member.

It is complicated to define key-shaped recesses on the inner surface of the bracket. Additionally, the engagement between the interferential face of the central pin and the inner face of the insulative member is so unreliable that the central pin would be moved axially in the insulative member when excessive mating force is encountered.

Hence, a coaxial connector having an improved central pin is highly desired.

SUMMARY OF THE INVENTION

Accordingly, an object of the present invention is to provide a coaxial connector includes a bracket defining a cavity, a central pin received in the cavity and an insulative member. The central pin includes a contact portion, a mounting portion, and a fixing portion disposed between the contact portion and the mounting portion. The fixing portion has at least an engaging face extending along a direction angled to a rotating direction of the central pin. The insulative member is mounted around the fixing portion of the central pin and disposed between the bracket and the central pin. The insulative member includes a working face engaging with the engaging face of the central pin.

The engaging face extends along a direction angled to a rotating direction of the central pin. A frictional force produced between the working face and the engaging face orients toward a direction angled with the rotating direction of the central pin. The central pin is prevented from generating a rotation in relative to the insulative member with the help of the frictional force. The central pin could withstand a strong torsional force under the frictional force.

Other objects, advantages and novel features of the invention will become more apparent from the following detailed description when taken in conjunction with the accompanying drawings.

DETAILED DESCRIPTION OF THE PREFERRED EMBODIMENT

Figure 1:
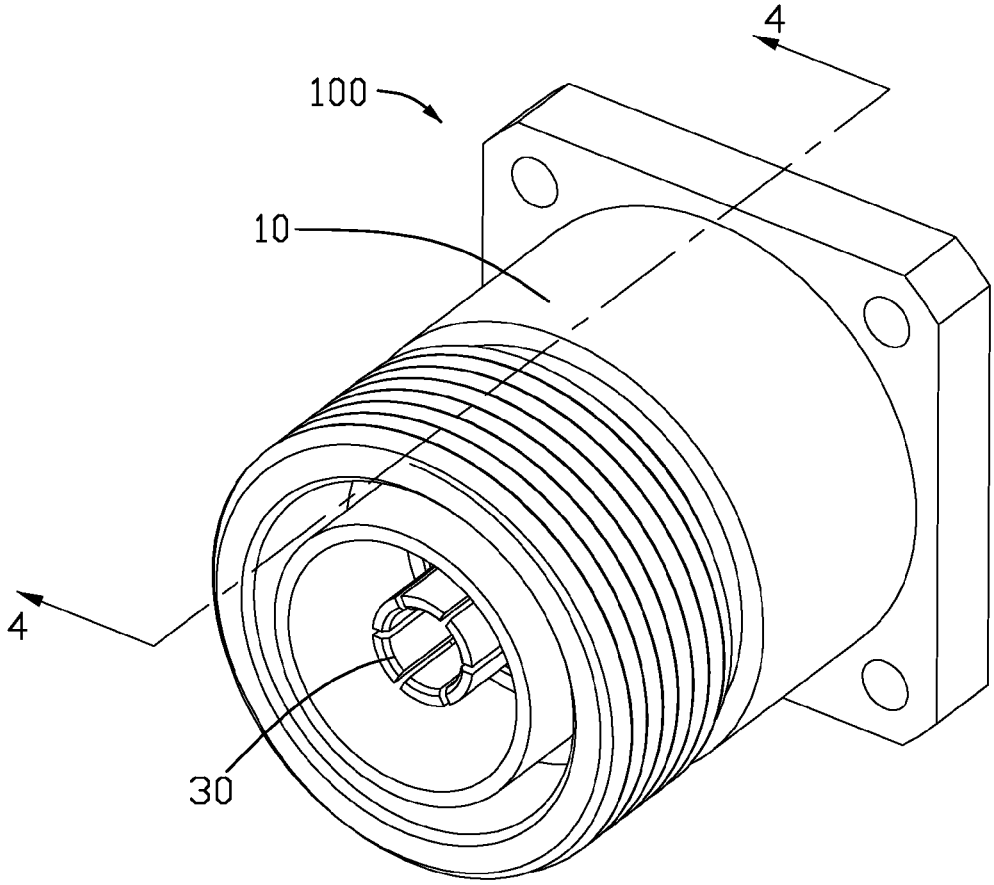
FIG. 1 is an assembled perspective view showing a coaxial connector in accordance with the present invention.
Figure 2:
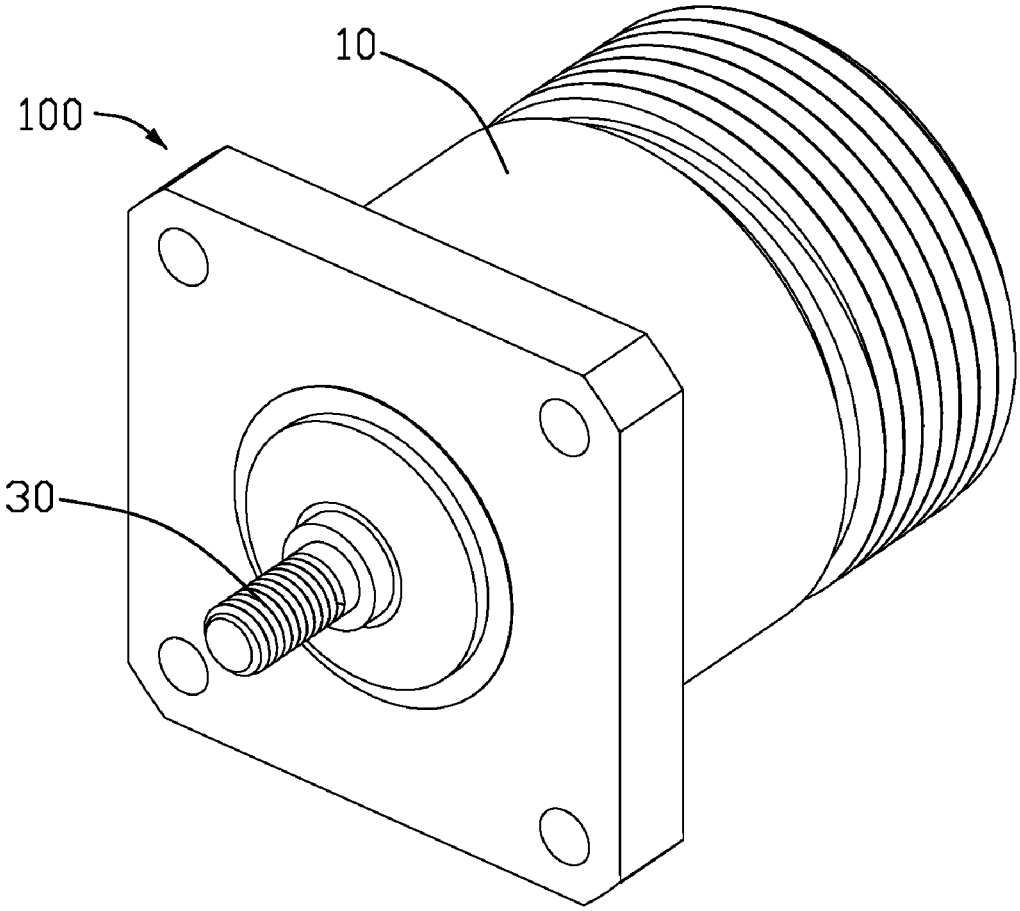
FIG. 2 is a view similar to FIG. 1, taken from another aspect.

Reference will now be made in detail to the preferred embodiment of the present invention. Referring to FIGS. 1-5, a coaxial connector 100 comprises a bracket 10, an insulative member 20, a central contact 30, a first cushion 40, a second cushion 50 and a ring 80.

Referring to FIGS. 1-4, the bracket 10 comprises a base portion 12, and a sleeve portion 11 connected with the base portion 12 and defining a cavity 15. The sleeve portion 11 comprises a whorled portion 111 having a whorled outer face, a mating portion 112 surrounding the cavity 15 and separated from the whorled portion 111 at a front portion of the sleeve portion 12. The bracket 10 has a protrusion 114 protruding from an inner surface of the sleeve portion 11 toward the cavity 15. In conjunction with FIG. 5, the sleeve portion 11 has an interferential inner surface 13.

Figure 3:
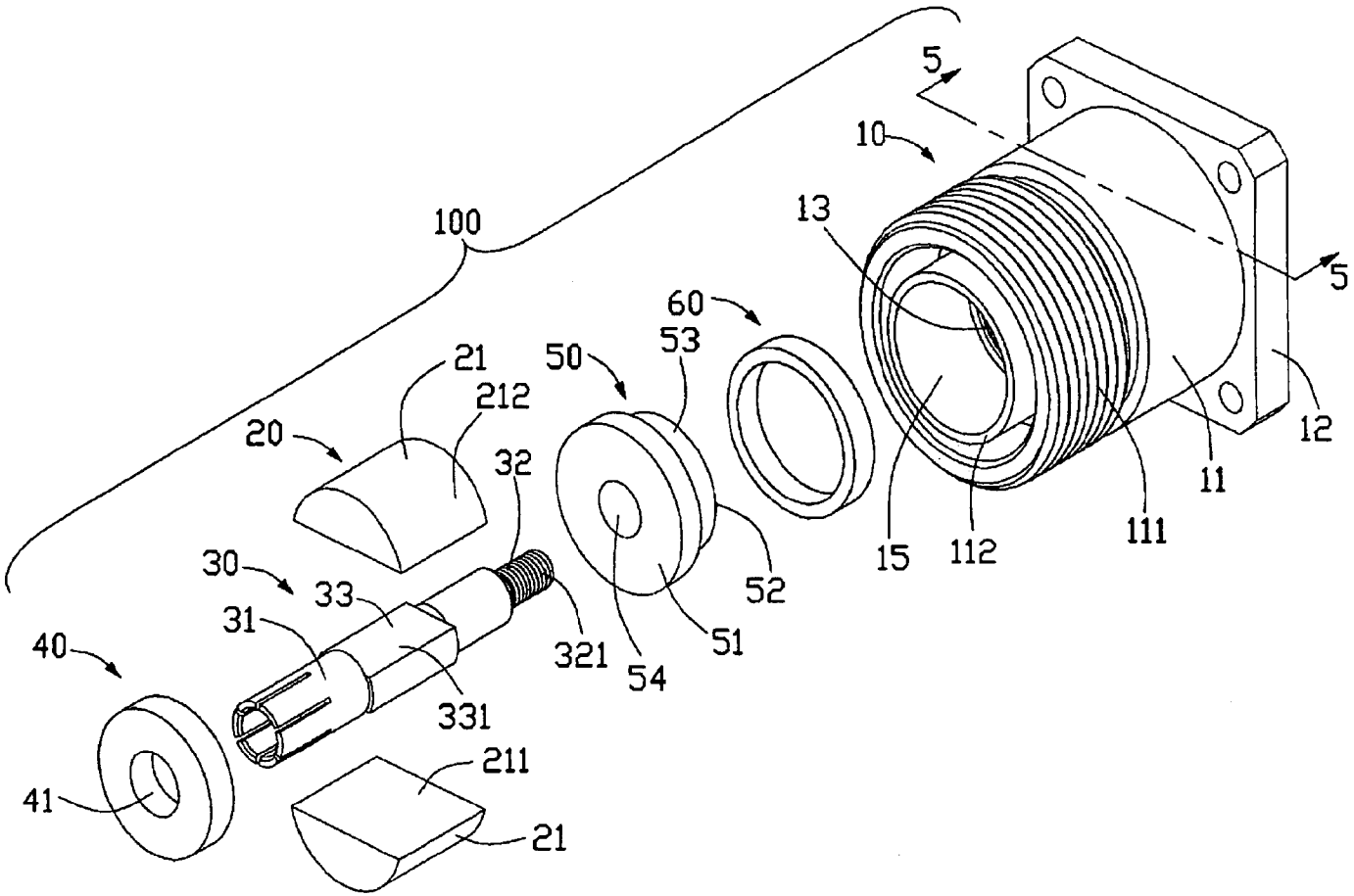
FIG. 3 is an exploded perspective view of the coaxial connector as shown in FIG. 1.
Figure 4:
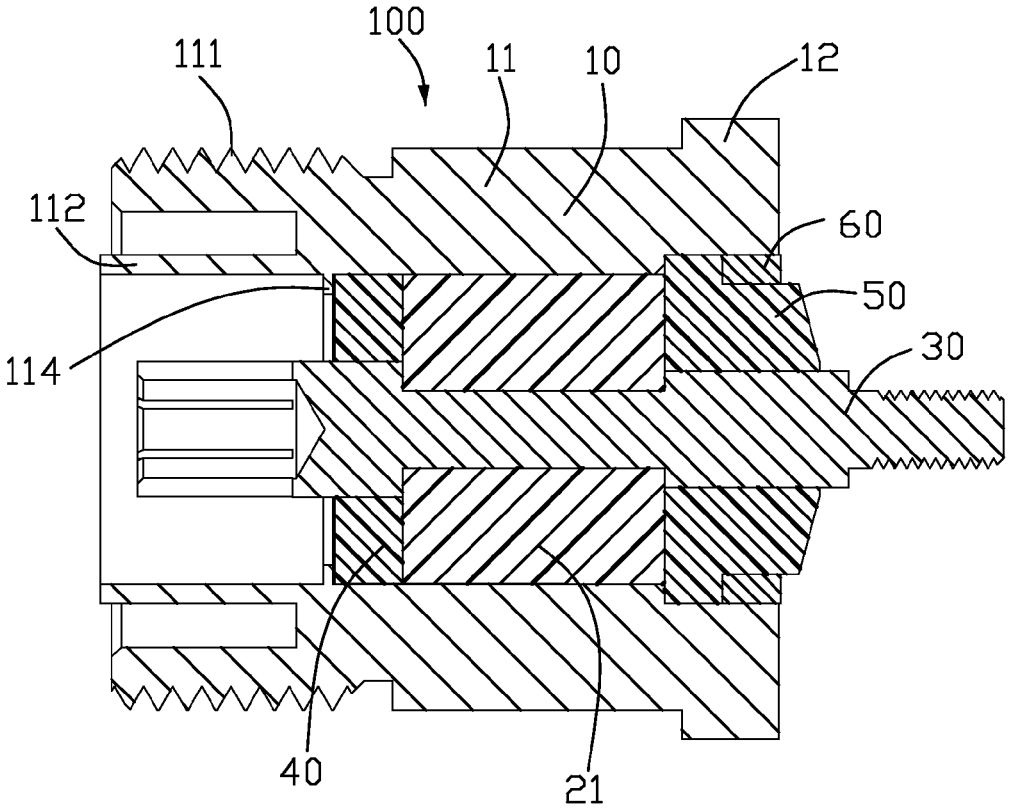
FIG. 4 is a cross-sectional view of the coaxial connector as shown in FIG. 1, taken along line 4-4.
Figure 5:
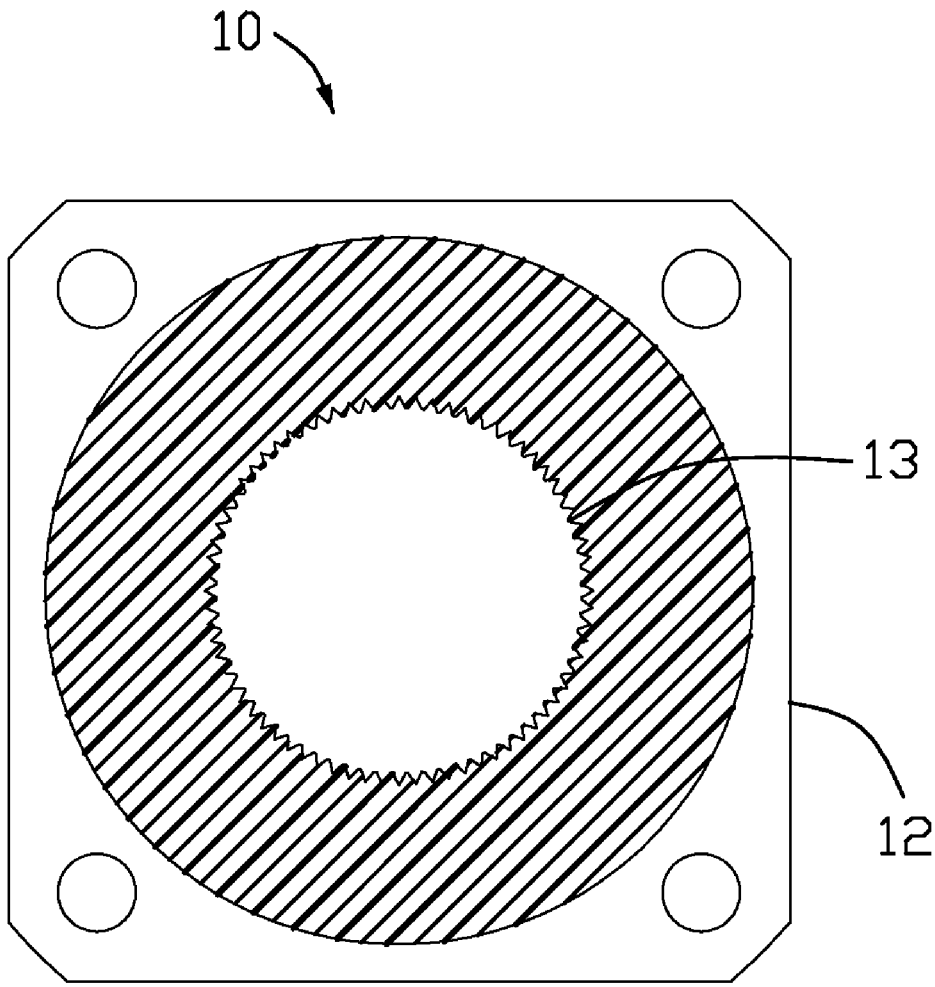
FIG. 5 is a cross-sectional view of the bracket as shown in FIG. 3, taken along line 5-5.

Referring to FIG. 3, the insulative member 2 comprises a pair of semi-columnar insulative portions 21. Each insulative portion 21 has an arc-like cooperating face 212 and a flattened working face 211.

The central pin 30 comprises a contact portion 31, a mounting portion 32 and a fixing portion 33 disposed between the contact portion 31 and the mounting portion 32. The mounting portion 32 includes a thread portion 321 having a plurality of threads formed thereon. The fixing portion 33 has a pair of opposite flattened engaging faces 331 parallel with each other. A distance between the pair engaging faces 331 is smaller than a diameter of the contact portion 31, and is smaller than a diameter of the mounting portion 32.

The first cushion 40 and the second cushion 50 are respectively made from insulative material. The first cushion 40 is formed with an annular configuration and has a first central hole 41 defined therethrough. The second cushion 50 includes a front annular portion 51, a rear annular portion 52 and a second central hole 54 defined therethrough. The front annular portion 51 has a diameter larger than that of the rear annular portion 52, to form a shoulder portion 53 between the front and rear annular portions 51, 52.

The ring 60 is a made from metal material to perform a fastening function in this embodiment. Optionally, the ring 60 could be made from resilient material to provide waterproof effect in another embodiment.

Referring to FIGS. 1-5, in assembling of the coaxial connector 100, the pair of insulative portions 21 are mounted onto the opposite sides of the central pin 30, with the working faces 211 of the insulative portions 21 engaging with corresponding engaging faces 331 of the central pin 30, respectively. The insulative portions 21 are restricted between the contact portion 31 and the mounting portion 32. The first cushion 40 and the second cushion 50 are respectively mounted on the contact portion 31 and the mounting portion 32 of the central pin 30, with the contact portion 31 inserting forwardly through the first central hole 41 and the mounting portion 32 inserting rearwardly through the second central hole 54. The pair of insulative portions 21 are sandwiched between the first and second cushions 40, 50. The central pin 30 together with the insulative member 20, the first and second cushions 40, 50 are received in the cavity 15 of the bracket 10. The first cushion 40 leans against the protrusion 114 of the bracket 10. The arc-like cooperating face 212 of the insulative member 20 has an interference with the interferential inner face 13 of the bracket 10 to enhance a frictional face between the bracket 10 and the insulative member 20. The ring 60 is assembled to the shoulder portion 53 of the second cushion 50 and abuts against the bracket 10, to fasten the second cushion 50 together with the central pin 30 in the cavity 15 of the bracket 10.

The flattened working faces 211 of the insulative member 20 engage with the flattened engaging faces 331 of the central pin 30 to exert a biasing force to central pin 30 along a direction perpendicular to the engaging face 331 and a frictional force between the engaging face 331 and the working face 211 orienting toward a direction angled to the rotating diretion of the central pin 30. The central pin 30 and the insulative member 20 are prevented from generating a rotation relative to each other due to the frictional force and the biasing force. The central pin 30 could withstand a strong torsional force with the help of the frictional force and the biasing force.

The central pin 30 could be formed with one engaging face 331 engaging with one insulative portion 21 in another embodiment, with a biasing force between one insulative portion 21 and one engaging face 331 becoming weaker.

In another embodiment, the central pin 30 could be formed with a protrusion (not shown) engaging with an indentation formed on the insulative member 20. The engaging face 331 of the central pin 30 is formed on the protrusion. The engaging face 331 extends toward the insulative member 20 and is angled to the rotating direction of the central pin 30. The frictional force between the engaging face 331 and the working face 211 orients toward a direction angled to the rotating diretion of the central pin 30. Optionally, the central pin 30 could be formed with an indentation (not shown) engaging with a protrusion formed on the insulative member 20.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A coaxial connector comprising:

a bracket defining a cavity;

a central pin received in the cavity and comprising a contact portion, a mounting portion, a fixing portion disposed between the contact portion and the mounting portion, said fixing portion having at least an engaging face extending along a direction angled to a rotating direction of the central pin; and an insulative member mounted on the fixing portion of the central pin and disposed between the bracket and the central pin, said insulative member having a working face engaging with the engaging face of the central pin, said insulative member being sandwiched and restricted between the contact portion and the mounting portion of the central pin; wherein said working face of the insulative member and the engaging face of the central pin are flattened, and wherein said fixing portion of the central pin is formed with a pair of opposite parallel engaging faces; and wherein said insulative member comprises a pair of semi-columnar insulative portions, said working face being formed on each insulative portion; and wherein a distance between the pair engaging faces is smaller than a diameter of the contact portion, and is smaller than a diameter of the mounting portion.

2. The coaxial connector as claimed in claim 1, wherein each insulative portion has an arc-like cooperating face opposite to the working face, and wherein said bracket has an interferential inner surface having an inference with the cooperating face of the insulative portion.

3. The coaxial connector as claimed in claim 1, further comprising a first cushion and a second cushion mounted on the central pin, said insulative member being sandwiched between the first and second cushions.

4. The coaxial connector as claimed in claim 3, wherein said bracket has a protrusion protruding toward the cavity, said first cushion mounted on the contact portion of the central pin and abutting against the protrusion.

5. The coaxial connector as claimed in claim 3, wherein said second cushion is formed with a shoulder portion, and wherein said coaxial connector comprises a ring mounted at the shoulder portion of the second cushion and abutting against the bracket.

6. The coaxial connector as claimed in claim 1, wherein said mounting portion of the central pin has a thread portion formed with a plurality of threads and extending outwardly of the bracket.

7. The coaxial connector as claimed in claim 1, wherein said bracket comprises a whorled portion having a whorled outer face, and a mating portion surrounding the cavity and separated from the whorled portion at a front portion of the bracket.

8. The coaxial connector as claimed in claim 1, wherein said insulative member exerts a biasing force to the central pin along a direction perpendicular to the engaging face of the central pin.

* * * * *